US006981656B2

(12) United States Patent
Fisher et al.

(10) Patent No.: US 6,981,656 B2
(45) Date of Patent: Jan. 3, 2006

(54) QUICK CLEANING HOT MELT ADHESIVE DISPENSING APPARATUS

(75) Inventors: Duane J. Fisher, Cumming, GA (US); Wesley C. Fort, Cumming, GA (US); John M. Raterman, Atlanta, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/412,541

(22) Filed: Apr. 11, 2003

(65) Prior Publication Data

US 2004/0217192 A1 Nov. 4, 2004

(51) Int. Cl.
*B05B 1/28* (2006.01)
*B05B 1/00* (2006.01)
*A62C 31/02* (2006.01)

(52) U.S. Cl. ..... 239/104; 239/589; 239/596; 239/600; 239/11

(58) Field of Classification Search ..... 239/104, 239/128, 133, 134, 135, 267, 268, 550, 551, 239/600, 589, 596, 11; 222/318, 255, 330, 222/504, 559, 146.5, 509, 518
See application file for complete search history.

(56) References Cited

U.S. PATENT DOCUMENTS

| | | | | |
|---|---|---|---|---|
| 3,570,725 | A * | 3/1971 | Baker et al. | 222/504 |
| 4,320,858 | A * | 3/1982 | Mercer et al. | 222/146.5 |
| 4,334,637 | A * | 6/1982 | Baker et al. | 222/146.2 |
| 4,537,357 | A * | 8/1985 | Culbertson et al. | 239/290 |
| 5,535,920 | A | 7/1996 | Blair, Jr. et al. | 222/1 |
| 5,700,322 | A * | 12/1997 | Fort | 118/50 |
| 5,919,384 | A | 7/1999 | Reifenberger et al. | 219/421 |
| 5,934,520 | A | 8/1999 | Byerly et al. | 222/504 |
| 5,979,794 | A * | 11/1999 | DeFillipi et al. | 239/135 |
| 6,039,217 | A | 3/2000 | Faulkner, III et al. | 222/146.5 |
| 6,422,428 | B1 * | 7/2002 | Allen et al. | 222/318 |

* cited by examiner

*Primary Examiner*—Davis Hwu
(74) *Attorney, Agent, or Firm*—Wood, Herron & Evans, L.L.P.

(57) ABSTRACT

Apparatus for dispensing thermoplastic material and configured for easy cleaning and maintenance procedures to address residual thermoplastic material in the apparatus. The apparatus includes a distribution body having an interior space for receiving a removable insert. The removable insert includes a flow passage for providing the thermoplastic material, for example, to a dispensing element. Alternatively, or in addition, the distribution body may be formed of separable portions to allow easy access to the passage and/or insert.

17 Claims, 4 Drawing Sheets

QUICK CLEANING HOT MELT ADHESIVE DISPENSING APPARATUS

FIELD OF THE INVENTION

The present invention generally relates to thermoplastic material dispensing apparatus and, more particularly, dispensing apparatus configured to be easily cleanable particularly when used for dispensing certain problematic hot melt adhesive materials, such as polyurethane reactive (PUR) adhesives.

BACKGROUND OF THE INVENTION

Hot melt adhesives are typically thermoplastic adhesives that are solid at room temperature and melted prior to use. Hot melt adhesives may be used during such diverse activities such as building construction, shoe manufacture, and book binding. In addition, many uses exist in the assembly of automobile parts, electronics, electrical equipment, appliances, electrical components, furniture and other widely ranging manufacturing processes. The common forms of hot melt adhesives include, for example, polyamide adhesives, pressure sensitive adhesives (PSA), ethylene vinyl acetate (EVA), polyurethane reactive (PUR) adhesives, and other types of adhesives. The present invention is especially applicable to PUR adhesives, however, its various aspects are applicable to other types of meltable thermoplastic materials as used in many circumstances, such as those mentioned above.

Clean up and maintenance procedures of adhesive dispensing systems are always important considerations in a manufacturing environment. PUR adhesives present additional problems and challenges in that these adhesives are moisture curable and are generally not easily cleaned or flushed from a dispensing system having a large number of small precision parts and passages. Thus, dispensing systems are especially difficult to clean and maintain when used with PUR hot melts and are therefore more likely to require increased down time and maintenance. This results in higher manufacturing costs.

Various components in an adhesive dispensing system will require cleaning and maintenance including adhesive distribution bodies such as the manifold or service block associated with a dispensing apparatus. Such an apparatus typically includes at least one dispensing module having an internal valve element for selectively opening and closing a discharge passage and thereby either allowing or preventing the discharge of adhesive in a desired manner. The module is often operated pneumatically, although electrically operated modules also exist. At least one module is mounted to a manifold or service block which supplies at least the molten hot melt adhesive to the valve module and, if pneumatically operated, may also supply air for operating the valve element within the module. In addition, if the valve module utilizes process air, for example, to produce a particular adhesive spray pattern, the process air may also be provided through the manifold or service block.

In view of the current challenges associated with cleaning and maintaining apparatus for dispensing thermoplastic material, it would be desirable to provide such apparatus, including service blocks, manifolds or other material distribution bodies in the dispensing system, with more easily cleanable and/or maintainable material supply and distribution passages in order to decrease cleaning and maintenance costs and the downtime associated with these procedures.

SUMMARY OF THE INVENTION

In one aspect, the present invention provides an apparatus for dispensing thermoplastic material which is configured for easy cleaning and maintenance procedures to address residual material in the apparatus. The apparatus generally comprises a distribution body having an interior space and a removable insert contained in the interior space. The interior space may be a throughbore in the distribution body or it may be another configuration of passage which may or may not be part of a network of passages in the distribution body. The removable insert includes one or more flow passages for providing thermoplastic material to a dispensing element, such as a valve module and may be easily removed for cleaning, maintenance, or replacement purposes. As one example, the removable insert can extend from one side of the distribution body at which it connects to a supply of the thermoplastic material to an opposite side of the distribution body where it connects, for example, to the valve module. The first end of the removable insert can include a fitting for connecting to a thermoplastic material supply conduit and the opposite end or second end can include a seal which is configured to contact the valve module and prevent leakage of the thermoplastic material. As one alternative, the insert may comprise a tubular network for disposition in a manifold.

In another aspect of the invention, the distribution body is comprised of at least two pieces which mate together along a flow passage and which may be separated to assist with cleaning and maintenance procedures associated with that flow passage. The flow passage itself may supply the thermoplastic material to the valve module or other dispensing element. Alternatively, the flow passage may receive the removable insert discussed above. In either instance, the split configuration of the distribution body allows for easier and quicker cleaning and maintenance procedures.

The invention further contemplates methods of operating thermoplastic material dispensing apparatus. According to one method, thermoplastic material is supplied to a dispensing element from a pressurized supply of the thermoplastic material through a flow passage in a tubular insert carried by a distribution body. Thermoplastic material is discharged from the dispensing element and then stopped. The flow passage of the tubular insert is depressurized and then the tubular insert is removed from the distribution body. The flow passage of the tubular insert is then cleaned or the tubular insert itself is replaced by another tubular insert prior to resuming use of the dispensing apparatus.

In accordance with another method of the invention, the material distribution body is comprised of at least first and second pieces which mate together along the length of a flow passage. The method generally involves the steps outlined above for the first embodiment, except that to facilitate quicker and easier cleaning, the first and second pieces of the distribution body are disconnected from one another after depressurizing at least that portion of the dispensing apparatus or system. The pieces need not be completely decoupled from each other but merely disconnected enough to facilitate access to portions of the flow passage. This flow passage along which the distribution body is split or disconnected may or may not also include a removable hollow or tubular insert which actually carries the thermoplastic material during operation. In either case, the method facilitates quicker and more effective cleaning and maintenance procedures.

These and other objects, advantages, and features of the invention will become more readily apparent from the following detailed description of the preferred embodiment taken in conjunction with the accompanying drawings.

DETAILED DESCRIPTION OF THE DRAWINGS

Figure 1:
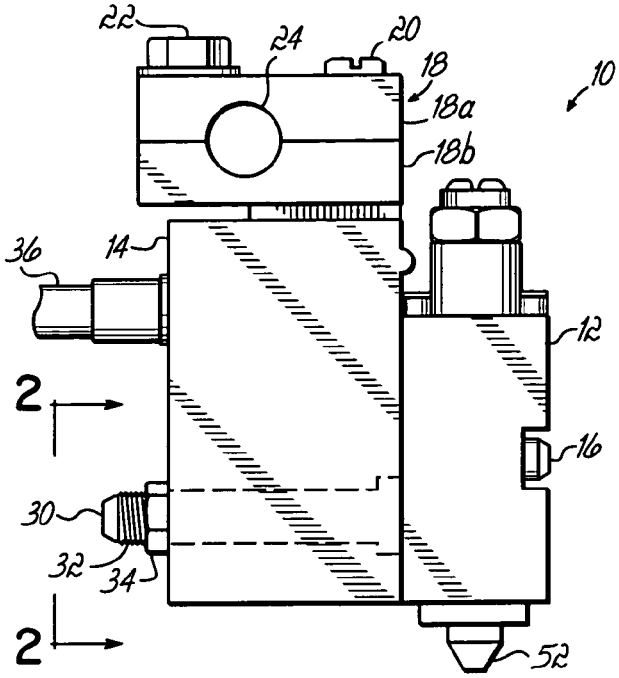
FIG. 1 is a side elevational view of a dispensing apparatus constructed in accordance with one embodiment of the invention.

FIGS. 1, 2 and 3A–3B illustrate a dispensing apparatus 10 comprised of a dispensing module 12 coupled to a liquid distribution body 14 by fasteners 16. The distribution bodies disclosed herein may be service blocks, manifolds, or other types of liquid distribution bodies having one or more passages for distributing liquid to a dispenser. A mounting block 18 is connected to service block 14 by fasteners 20 and may be releasably coupled to a mounting rod (not shown) using fasteners 22 to clamp block portions 18*a*, 18*b* around the mounting rod (not shown) which is received in a hole or throughbore 24. A thermoplastic material inlet 30 is provided in a fluid fitting 32 secured to service block 14 by turning a hex portion 34. An electric cable 36 supplies power to a heater (not shown) and RTD (not shown) within service block 14. Apparatus 10 is therefore generally similar to the one shown in U.S. Pat. No. 4,785,996, assigned to the assignee of the present invention, and the disclosure of which is incorporated herein by reference. Fitting 32 is coupled to an insert 40 which is received in a removable fashion within service block 14 in accordance with one aspect of the invention. Thermoplastic material, such as a PUR hot melt adhesive or another type of hot melt adhesive, may be introduced through inlet 30 and respective passages 42, 44 in fitting 32 and removable insert 40. The material then enters an inlet port 46 in module 12 and an internal module passage or passages 48. The material will discharge from an outlet 50 of a nozzle 52 when a reciprocating valve element 54 is moved upwardly from the closed position shown in FIG. 2 to an open position. Removable insert 40 is sealed against module 12 by an O-ring 56 or by another suitable sealing method. Insert 40 may be removed from service block 14 by uncoupling module 12 and service block 14 and removing nut 34. If necessary, fitting 32 and O-ring 56 may be removed, respectively, from internal threads 60 and annular recess 64 of flange 62. In this manner, insert 40 may be quickly and effectively cleaned of any residual adhesive within material passage 44 and elsewhere on insert 40 and then insert 40 may be replaced within surface block 14. Alternatively, insert 40 may be replaced by a different insert.

FIGS. 4 and 5, FIG. 6, and FIG. 7 respectfully illustrate three alternative embodiments of the invention in which like elements with the first embodiment described above are indicated using like reference numerals. These identical components therefore need not be described again. Modified components are indicated below by like reference numerals with prime marks (′), double prime marks (″) or triple prime marks (‴). The embodiment of FIGS. 4 and 5 does not use the removable insert 40 described in connection with the first embodiment. Instead, to allow for easy cleaning and maintenance, service block 14′ is comprised of at least two component parts 14*a*, 14*b* which may be separated to expose portions of a thermoplastic material inlet or flow passage 70*a*, 70*b*. Thus, when cleaning and maintenance is necessary, fasteners 72 may be removed from threaded holes 72*a* to separate service block portions 14*a* and 14*b* to fully expose inlet passage portions 70*a*, 70*b* for easy cleaning.

Figure 4:
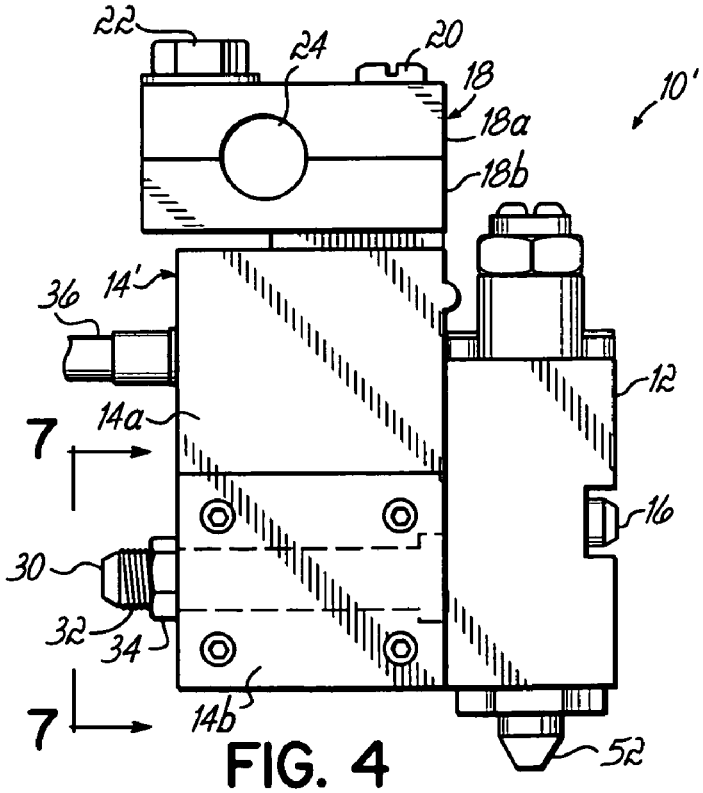
FIG. 4 is a side elevational view of a dispensing apparatus constructed in accordance with another embodiment of the invention.
Figure 5:
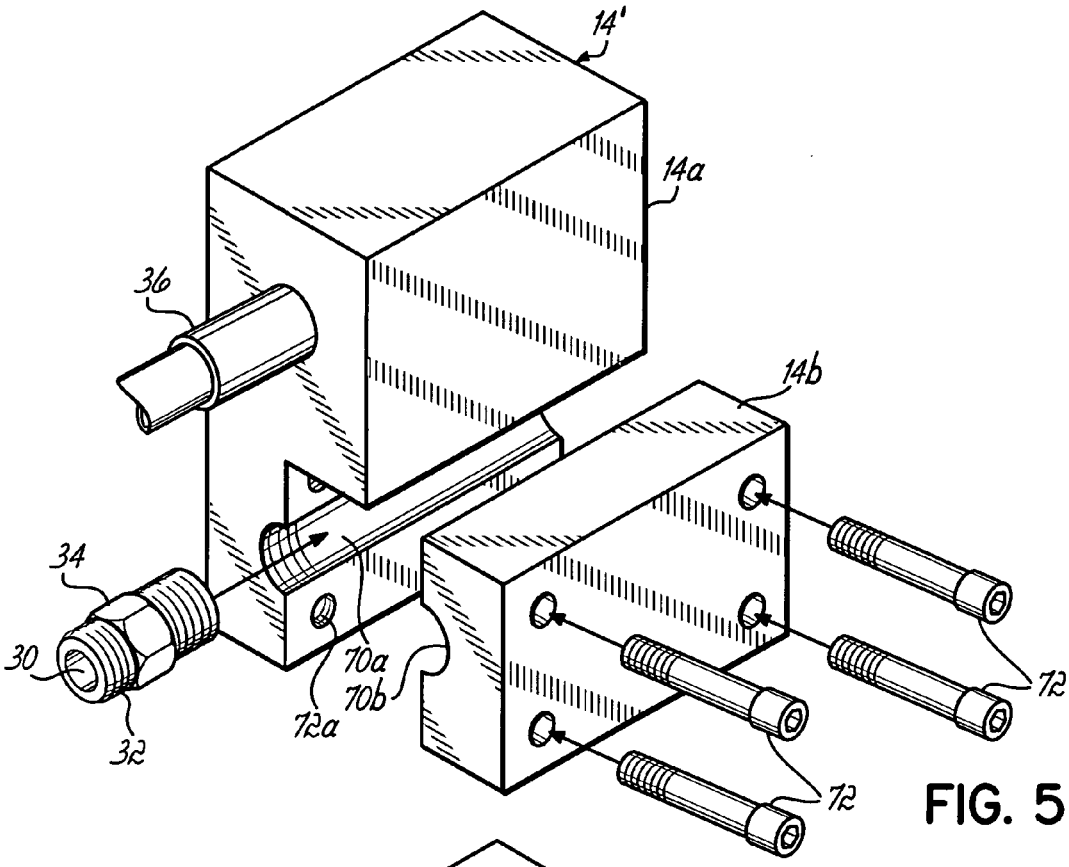
FIG. 5 is an exploded perspective view of the service block illustrated in FIG. 4.
Figure 6:
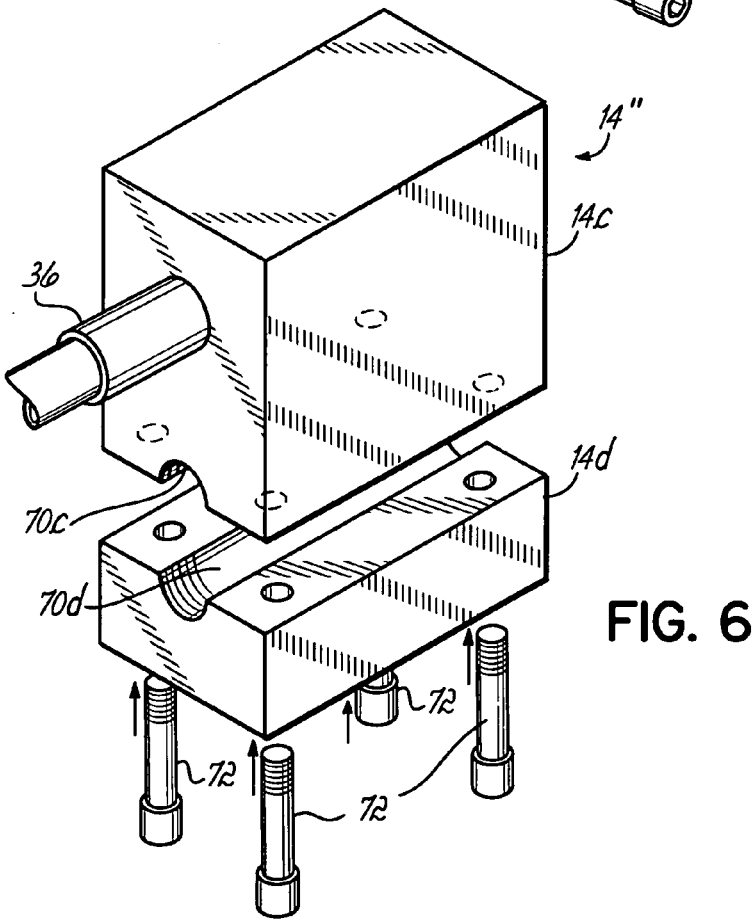
FIG. 6 is an exploded perspective view of a service block constructed in accordance with another embodiment.

FIG. 6 illustrates another embodiment similar to FIGS. 4 and 5, except that fasteners 72 retain a lower portion 14*c* of service block 14″ to an upper service block portion 14*d*. The two portions 14*c*, 14*d* are easily separated from one another to again expose the entire length of the material inlet or flow passage portions 70*c*, 70*d*.

Figure 2:
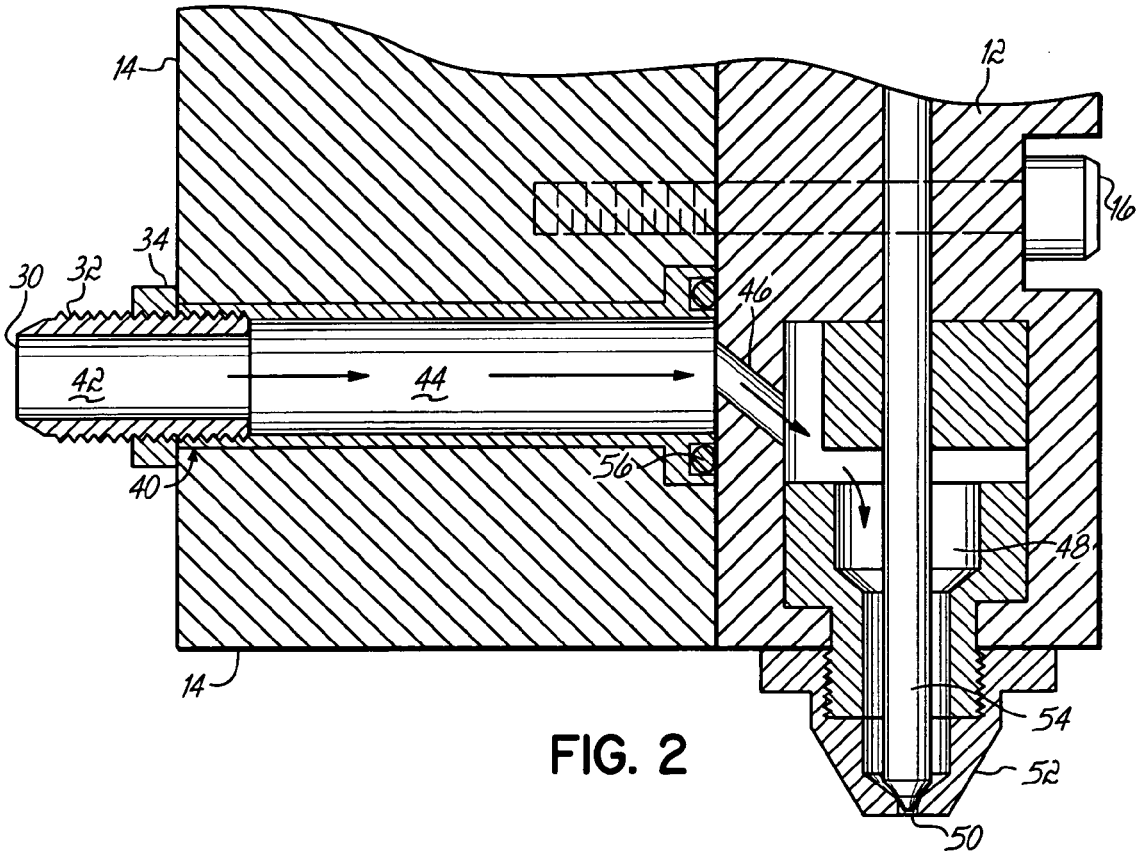
FIG. 2 is a cross sectional view taken along line 2—2 of FIG. 1.
Figure 3A:
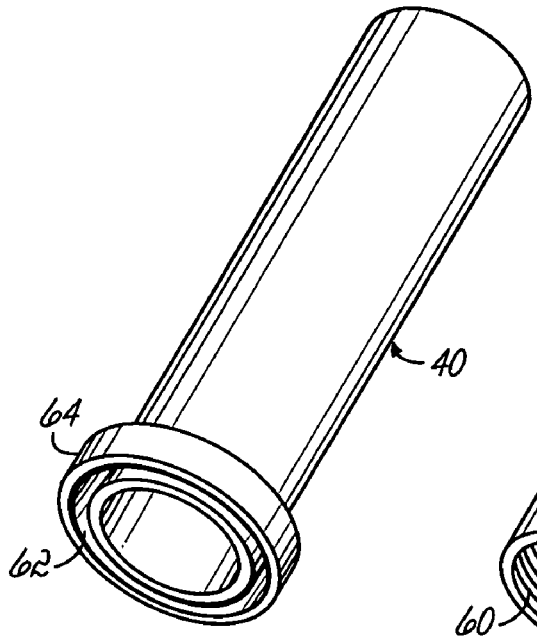
FIG. 3A is a perspective view of the removable insert shown in FIG. 2.
Figure 3B:
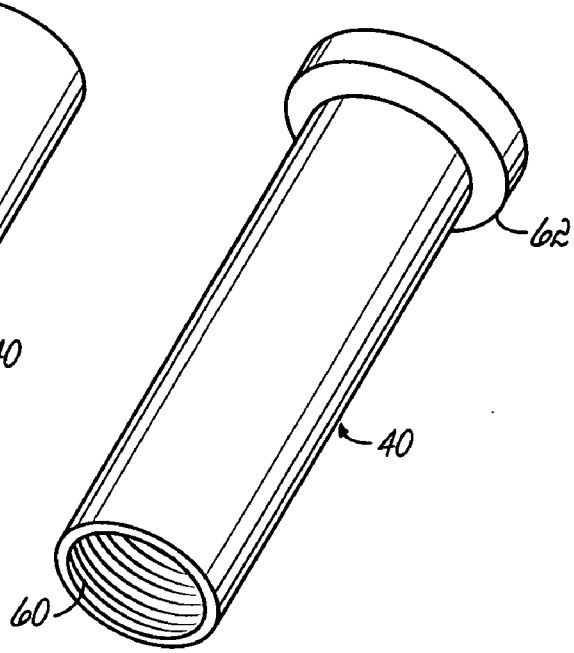
FIG. 3B is a perspective view from the opposite side of the insert shown in FIG. 3A.
Figure 7:
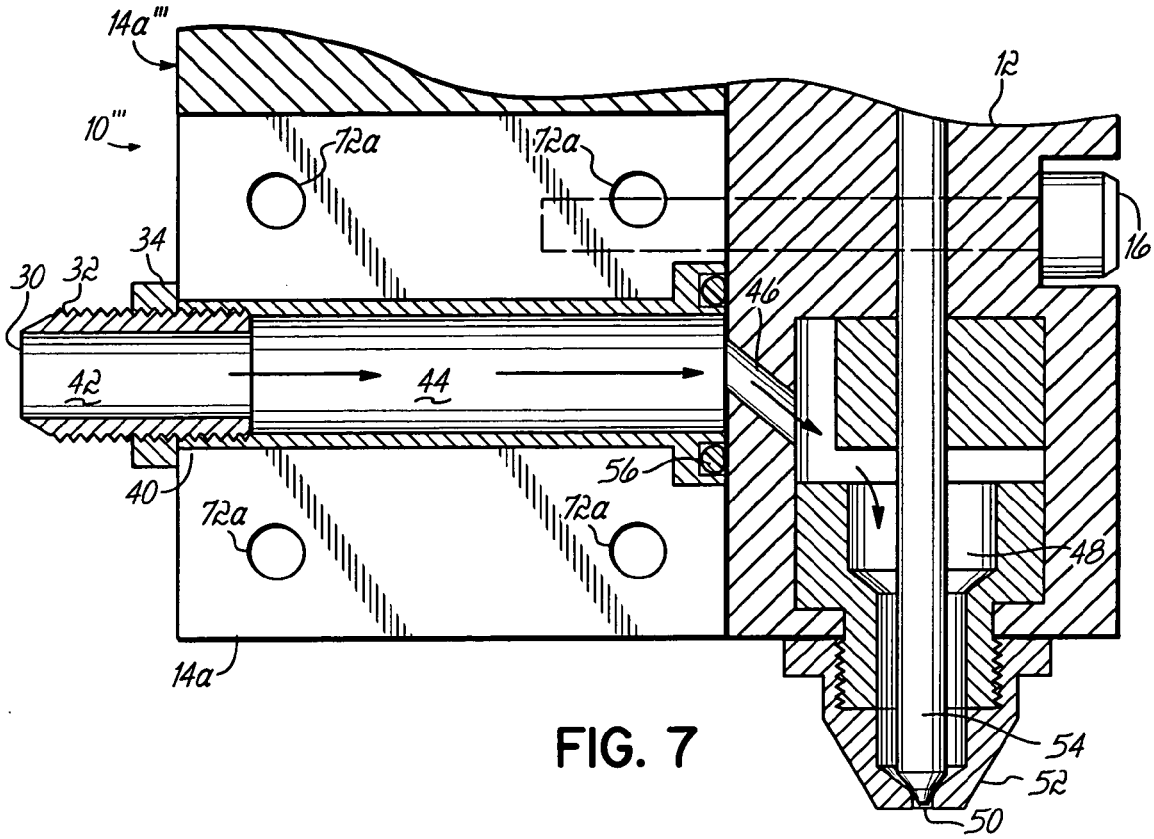
FIG. 7 is a cross sectional view similar to FIG. 2, but illustrating an alternative service block.

FIG. 7 is a cross sectional view similar to FIG. 2, but illustrating a dispensing apparatus 10‴ which essentially combines the features of a removable insert and a separate material distribution body. It will be appreciated that with the combination of a separable service block 14‴ having portions 14*a*, 14*b* (FIG. 5) and a removable insert 40, it will be easier in various situations to access and remove insert 40 for cleaning and/or replacement purposes. In this regard, service block portion 14*b* may be removed as shown in FIG. 7 and fasteners 16 may simply be loosened to allow insert 40 to be removed from service block portion 14*a* and then cleaned or replaced as necessary.

Figure 8:
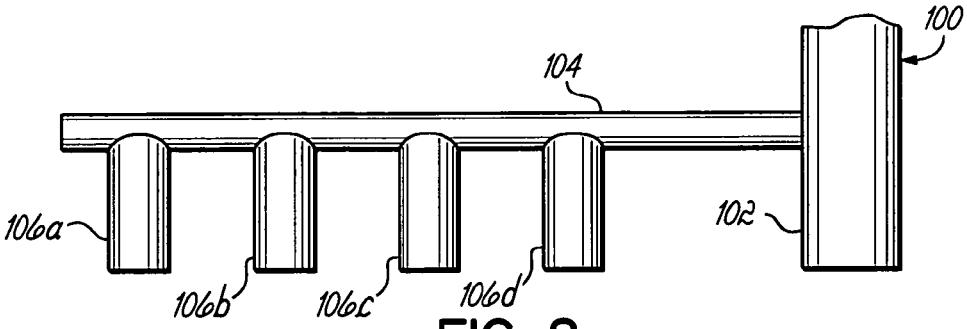
FIG. 8 is a fragmented view of an alternative tubular inserted constructed according to the invention.
Figure 9:
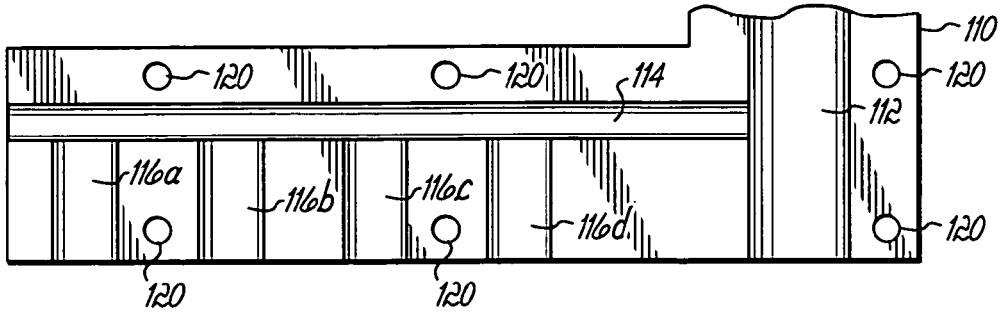
FIG. 9 is a fragmented view of a manifold section configured to receive the tubular insert of FIG. 8.

FIGS. 8 and 9 illustrate an alternative embodiment of the invention in which a tubular insert 100 may be removably affixed within a manifold 110. Specifically, insert 100 is shown in FIG. 8 and includes interconnected tubular sections 102, 104, 106*a*–*d*. These tubular sections 102, 104, 106*a*–*d* may contain interconnected flow passages for various uses, such as for directing flow to one or more dispensers, directing flow through a filter, or providing system drainage. As with the previous embodiments, the various sections may be threaded and/or coupled to suitable fittings appropriate for their intended use. Tubular insert 100 is removably receivable within a manifold 110 (FIG. 9) having interior spaces or passages 112, 114, 116*a*–*d* which are sized and shaped to receive sections 102, 104, 106*a*–*d* of insert 100. Manifold 110 includes another half (not shown) which may be secured in place using fasteners in screw holes 120 after insert 100 is received within passages or spaces 112, 114, 116*a*–*d*.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims.

What is claimed is:

1. Apparatus for dispensing thermoplastic material from a dispensing module and configured for easy cleaning and maintenance procedures to address residual thermoplastic material in the apparatus, comprising:

a thermoplastic material distribution body having an interior space;

a removable insert contained in said interior space, said removable insert including a flow passage with an outlet for providing the thermoplastic material to the dispensing module; and a seal configured to be positioned between said removable insert and the dispensing module;

wherein said distribution body includes a first side for receiving the thermoplastic material and a second side for discharging the thermoplastic material, and said removable insert is coextensive with said distribution body between said first and second sides of said distribution body.

2. The apparatus of claim 1, wherein a first end of said removable insert includes a fitting for communicating the thermoplastic material between a thermoplastic material supply conduit and said flow passage.

3. The apparatus of claim 2, wherein a second end of said removable insert carries said seal.

4. The apparatus of claim 1, wherein said interior space has a length and said distribution body comprises at least two pieces which mate together along said length, said two pieces capable of being separated to aid the removal of said insert.

5. The apparatus of claim 4, wherein said distribution body is a manifold and said removable insert includes a plurality of interconnected flow passages.

6. Apparatus for dispensing thermoplastic material and configured for easy cleaning and maintenance procedures for addressing residual material in the apparatus, comprising:

a valve module including an inlet for receiving the thermoplastic material, a discharge passage in fluid communication with said inlet and a valve element configured to selectively allow and prevent flow of the thermoplastic material through said discharge passage;

a distribution body coupled to said valve module, said distribution body having an interior space;

a removable insert contained in said interior space, said removable insert including a flow passage coupled to said inlet for providing the thermoplastic material to said inlet;

wherein said distribution body includes a first side for receiving the thermoplastic material and a second side coupled to said valve module for discharging the thermoplastic material from the flow passage of said removable insert into the inlet of said valve module, and said removable insert is coextensive with said distribution body between said first and second sides of said distribution body.

7. The apparatus of claim 6, wherein a first end of said removable insert includes a fitting for communicating the thermoplastic material between a thermoplastic material supply conduit and said flow passage.

8. The apparatus of claim 7, wherein a second end of said removable insert includes a seal configured to contact the valve module and prevent leakage of the thermoplastic material.

9. The apparatus of claim 6, wherein one end of said removable insert includes a seal configured to contact the valve module and prevent leakage of the thermoplastic material.

10. The apparatus of claim 6, wherein said interior space has a length and said distribution body comprises at least two pieces which mate together along said length, said two pieces capable of being separated to aid the removal of said insert.

11. Apparatus for dispensing thermoplastic material and configured for easy cleaning and maintenance procedures for addressing residual thermoplastic material in the apparatus, comprising:

a distribution body having an interior space having a length and adapted to communicate between a supply of the thermoplastic material and a dispensing element by delivering the thermoplastic material in a flow path extending along said length, said distribution body comprised of at least two pieces which are releasably secured together such that said interior space may be divided along a direction parallel to said flow path into respective portions extending along said length of said interior space when said two pieces are disconnected to assist with the cleaning and maintenance procedures.

12. The apparatus of claim 11, wherein the distribution body is a service block.

13. The apparatus of claim 11, wherein the distribution body is a manifold.

14. A method of operating a thermoplastic material dispensing apparatus including a distribution body and a valve module, comprising:

positioning a tubular insert within an interior space of the distribution body such that the interior space and the tubular insert are coextensive between respective sides of the distribution body;

supplying the thermoplastic material from a pressurized supply of the thermoplastic material into a flow passage in the tubular insert;

directing the thermoplastic material from the flow passage into an inlet of the valve module;

discharging the thermoplastic material from the valve module;

stopping the discharge of the thermoplastic material;

depressurizing the flow passage in the tubular insert;

removing the tubular insert from the distribution body; and either cleaning the flow passage of the tubular insert or replacing the tubular insert with another tubular insert prior to again discharging the thermoplastic material.

15. The method of claim 14, wherein the interior space has a length and the distribution body comprises at least first and second pieces with portions of the first and second pieces mating with the tubular insert, and further comprising:

separating the two pieces by dividing the interior space lengthwise before removing the tubular insert.

16. A method of operating a thermoplastic material dispensing apparatus, the apparatus including a distribution body comprised of at least first and second pieces which mate together lengthwise along a thermoplastic material flow passage so as to divide the flow passage along a length thereof, the method comprising:

supplying the thermoplastic material to a dispensing element from a pressurized supply of the thermoplastic material through the flow passage of the distribution body;

discharging the thermoplastic material from the dispensing element;

stopping the discharge of the thermoplastic material;

depressurizing the flow passage of the distribution body;

disconnecting the first piece of the distribution body from the second piece of the distribution body in a direction extending along the length of the flow passage;

cleaning portions of the flow passage in the first and second pieces; and reconnecting the first and second pieces.

17. The apparatus of claim 11, further comprising:

a valve module including said dispensing element and adapted to receive the thermoplastic material from said distribution body and selectively deliver the thermoplastic material to said dispensing element.

* * * * *